United States Patent [19]

Dyett

[11] 4,207,907

[45] Jun. 17, 1980

[54] CIGARETTE MAKING MACHINE

[75] Inventor: Derek H. Dyett, London, England

[73] Assignee: Molins, Ltd., London, England

[21] Appl. No.: 921,228

[22] Filed: Jul. 3, 1978

[30] Foreign Application Priority Data

Jul. 8, 1977 [GB] United Kingdom ..... 28687/77

[51] Int. Cl.[2] ..... A24C 5/18

[52] U.S. Cl. ..... 131/84 B; 131/84 C; 131/110; 198/689

[58] Field of Search ..... 131/84, 84 B, 84 C, 131/110; 198/689, 837

[56] References Cited

U.S. PATENT DOCUMENTS

| | | | |
|---|---|---|---|
| 2,941,653 | 6/1960 | Kriemelmeyer, Jr. | 198/689 X |
| 3,169,958 | 2/1965 | Grossi | 198/689 X |
| 3,850,177 | 11/1974 | Cabbe | 131/84 B X |

*Primary Examiner*—Stephen C. Pellegrino

*Attorney, Agent, or Firm*—Craig & Antonelli

[57] ABSTRACT

A cigarette making machine includes an air-pervious band which carries a cigarette filler stream by means of suction onto a continuous wrapper web in which the filler stream is enclosed to form a cigarette rod, characterized by a second air-pervious band (30; 66) which runs within the first band (14; 56) and contacts and supports the first band at least along part of the run of the first band along which the filler stream (10; 54) is carried.

11 Claims, 6 Drawing Figures

CIGARETTE MAKING MACHINE

This invention is concerned particularly with improvements in the type of machine known as the Molins Mark 8 or Mark 9 cigarette making machine. In that type of machine, a cigarette filler stream is formed by showering tobacco upwards, with the aid of an air stream, to a suction band on which the filler stream forms, the filler stream (preferably after trimming) being deposited on a continuous wrapper web directly by the suction band. However, this invention is applicable in general to any machine in which a filler stream is carried by a suction band which then deposits the filler stream on a wrapper web; the filler stream could in general be formed initially on the suction band or could be formed elsewhere for subsequent transfer onto the suction band.

According to the present invention, a cigarette making machine includes an air-pervious band which carries a cigarette filler stream by means of suction onto a continuous wrapper web in which the filler stream is enclosed to form a cigarette rod, characterised by a second air-pervious band which runs within the first band and contacts and supports the first band at least along part of the run of the first band along which the filler stream is carried.

One advantage of this invention is that it enables the first band to be made narrow enough to enter easily into the U-shaped trough which needs to be formed by the wrapper web at the position at which the filler stream is received by the web. However, the second band can be made wide enough to have substantial bearing surfaces along its side edges by which it can be supported, and the greater width of the second band also makes for greater durability. The presence of the second band also prolongs the life of the first band since the first band need not run over stationary support surfaces.

The second band is preferably supported by air bearings in regions adjacent to both its edges. For that purpose, the second band may be of stainless steel and have perforations only in a central region through which suction must be transmitted to hold and compress the filler stream; alternatively, the second band may be of woven nylon or woven steel, in which case it preferably has wide selevedges.

The first band may also comprise a perforated stainless steel web or a woven band. In order to have a rough surface capable of providing an effective drive on the tobacco, the perforations in the case of a perforated web may be of relatively large diameter (e.g. 1, 1.5, 2 or 2.5 mm diameter) or in the case of a woven band the weave may be coarse. On the other hand, in order to prevent an excessive flow of small particles of tobacco through the bands, the second band may have smaller perforations or a finer weave.

Examples of machines according to this invention are shown in the accompanying drawings.

Figure 1:
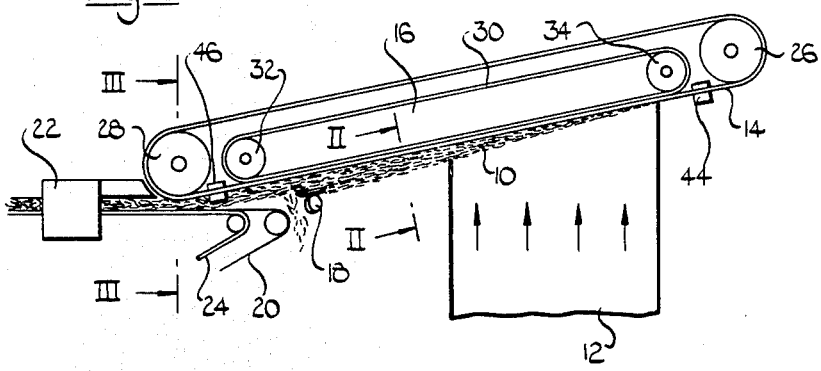
FIG. 1 is a diagrammatic elevation of one machine.

FIG. 1 shows a cigarette making machine which is basically like a Molins Mark 9 machine in that a filler stream 10 is formed by showering tobacco upwards through a vertical chimney 12 by means of an upward-moving air stream to form the filler stream on the underneath surface of the operative run of a first air-previous band 14. The filler stream is held on the band and is compressed by suction applied through the band from a suction chamber 16. After being trimmed by a trimmer 18, the filler stream is deposited on a continuous wrapper web 20 which is driven through a gerniture (rod forming device) 22 by a garniture tape 24. The band 14 passes around pulleys 26 and 28; the pulley 28 rotates about a fixed axis, while the pulley 26 is movable away from the pulley 28 to tension the band 14.

Within the band 14 there is a second air-pervious band 30 which passes around pulleys 32 and 34; again, the pulley 32 rotates about a fixed axis while the pulley 34 is movably mounted to tension the band 30.

Figure 2:
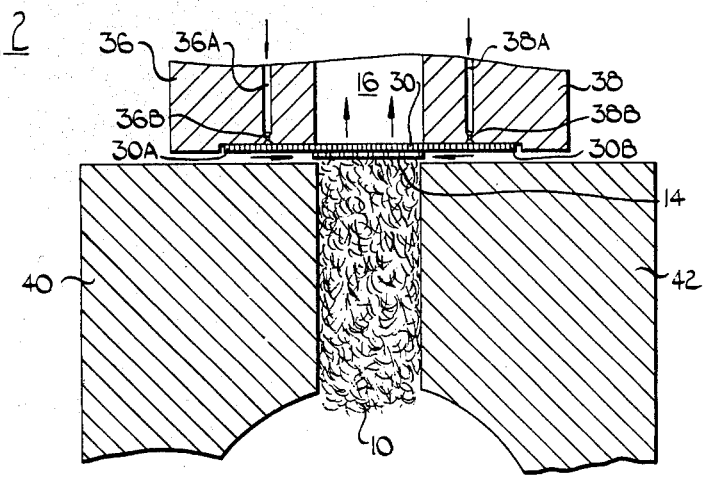
FIG. 2 is an enlarged section on the line II—II in FIG. 1.

As shown particularly in FIG. 2 the width of the band 14 is approximately the same as that of the tobacco stream 10 (in fact is only slightly greater), while the band 30 is considerably wider. Side portions 30A and 30B of the band 30 lie adjacent to walls 36 and 38 defining the suction chamber 16, the band 30 being spaced slightly from the walls 36, 38 by means of air bearings formed by compressed air supplied to passages 36A and 38A which are formed at regular intervals along the walls 36 and 38. The passages include restrictions 36B and 38B.

As shown also in FIG. 2, the filler stream 10 has its sides confined by fixed rails 40 and 42. These rails, or extensions of them, carry devices 44 and 46 (see FIG. 1) to maintain the band 14 along the correct track.

The upper surfaces of the rails 40 and 42 are spaced slightly from the band 30 and from the outer portions of the walls 36 and 38 to allow air from the atmosphere to flow inwards (in the direction shown by arrows) to prevent particles of tobacco from the filler stream 10 entering the gaps between the members 40, 42 and the side portions 30A, 30B of the band 30. The air is drawn in by virtue of the suction produced by the suction chamber 16. This feature has been more fully described in our British Patent specification No. 1,360,597.

Figure 3:
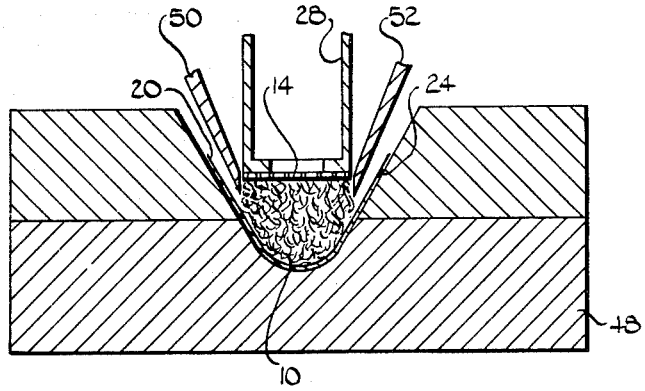
FIG. 3 is an enlarged section of the line III—III in FIG. 1.

FIG. 3 is a cross-section at the point at which the trimmed filler stream 10 is deposited onto the wrapper web 20. At this point the wrapper web has already been formed into a trough shape with the aid of a garniture bed 48 and members 50 and 52, which latter members also confine the tobacco stream.

The following modification is possible. The first band may be arranged to receive the tobacco shower while moving in a generally downward direction. The chimney may then be horizontal, e.g. as shown in our British Pat. specification No. 1,396,272.

Figure 4:
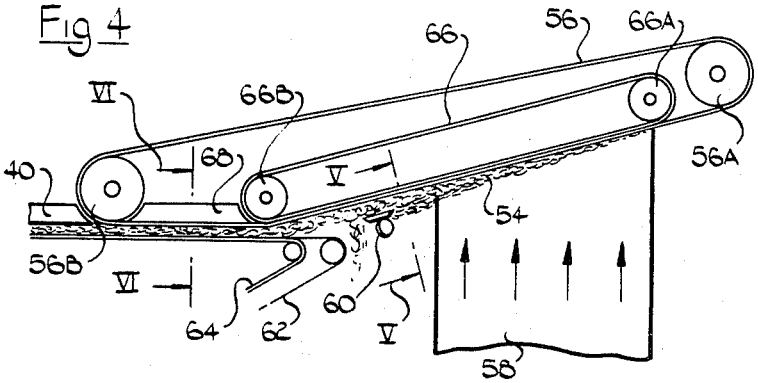
FIG. 4 is a diagrammatic elevation of a different machine.

FIG. 4 shows a different machine. As in FIG. 1, a filler stream 54 is formed on a first band 56 by showering tobacco upwards through a chimney 58; the band 56 passes around pulleys 56A and 56B. A trimmer 60 removes excess tobacco, and the filler stream is then fed onto a continuous wrapper web 62 supported by a garniture tape 64.

A second air-previous band 66, passing around pulleys 66A and 66B, supports the band 56 in the region over the chimney 58 and up to the point at which the filler stream reaches the wrapper web 62. However, this machine differs from FIG. 1 mainly in that the band 56 bends around the pulley 66B and then proceeds in a nearly horizontal direction towards its return pulley 56B so as to remain in engagement with the filler stream after the filler stream has reached the wrapper web. In the region of this continued engagement, the band 56 is backed by a support member 68 and converges slightly towards the wrapper web so as to compress the filler stream. The band 56 therefore carries out at least part of the mechanical compression of the filler stream which, in FIG. 1, must be carried out by a stationary tongue forming part of the garniture 22 in a well known manner.

Figure 5:
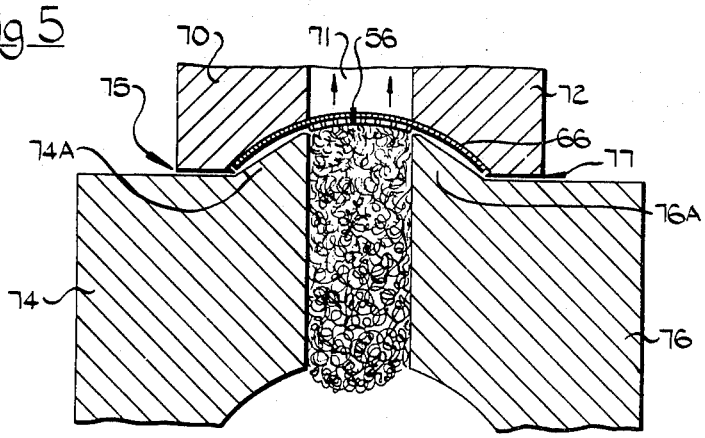
FIG. 5 is an enlarged crossed-section on the line V—V in FIG. 4.

As shown in FIG. 5, the bands 56 and 66 are constrained by cooperating curved surfaces on suction chamber walls 70 and 72 so as to have a curved cross-section. This imparts a curved cross-section to the upper surface of the filler stream, which helps in the final shaping of the filler stream to a circular cross-section. Trough rails 74 and 76 confining the sides of the filler stream have upwardly projecting portions 74A and 76A to reach into the hollow of the curved band 66.

As in FIG. 2, the suction in suction chamber 71 draws in some air from the atmosphere through gaps 75, 77.

Figure 6:
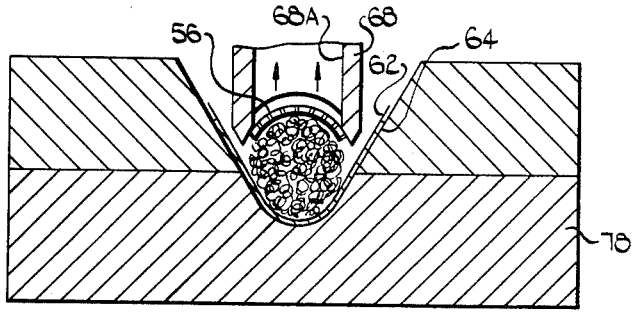
FIG. 6 is an enlarged section on the line VI—VI in FIG. 4.

As shown in FIG. 6, the member 68 supporting the band 56 has a lower surface which is curved in cross-section to maintain the curved cross-section of the band 56 so as to assist further in shaping the filler stream. The member 68 may include a series of slots 68A through which suction is applied. The arrangement, as already mentioned, may be such that the cooperation of the band 56 and the garniture bed 78 is such as to compress the filler stream to its final circular cross-section. However, the final compression may alternatively be achieved by means of a short stationary tongue. In other words, the part 40 shown in FIG. 4 may comprise simply a device for folding the wrapper web around the filler stream or may also include a short tongue upstream of the folding device.

In order to be able to form curved cross-sections as shown in FIG. 5 and 6, the bands 56 and 60 are preferably woven from a flexible material such as nylon.

Instead of being formed to a curved cross-section, the bands 56 and 66 in FIG. 4 may remain flat in cross-section, in which case it is necessary to include a tongue in the part 40 to shape the upper surface of the filler stream in the manner necessary to produce a circular cross-section.

I claim:

1. A cigarette making machine including a first air-previous band, means for forming on the band a cigarette filler stream, means for applying suction through the band whereby the filler stream is held on the band and is thereby carried to a continuous wrapper web in which the filler stream is enclosed to form a cigarette rod, a second air-previous band, and means for mounting the second band within the first band, whereby the second band contacts and supports the first band at least along part of the run of the first band along which the filler stream is carried by the first band.

2. A machine according to claim 1 in which the two bands are driven at the same speed.

3. A machine according to claim 1 in which the first band has a width which is not very much greater than that of the filler stream and in which the second band is substantially wider so that its edges extend beyond the edges of the first band.

4. A machine according to claim 3 in which the edge portions of the second band are supported by air bearings.

5. A machine according to claim 1, in which the first band is arranged to carry the filler stream along a straight path extending obliquely downwards to the point at which the filler stream reaches the wrapper web, the second band being arranged to pass around a return pulley upstream of that point.

6. A machine according to claim 1, in which the first band is arranged to carry the filler stream initially along a substantially straight path extending at least obliquely downwards to a point at which the filler stream reaches the wrapper web, and at which point the first band bends around a return pulley for the second band so that it can then move along an approximately horizontal path in which it is approximately parallel to the wrapper web.

7. A machine according to claim 6 in which the approximately horizontal path of the second band is in a direction such that the second band converges slightly towards the wrapper web so as to compress the filler stream towards its final cross-section.

8. A machine according to claim 6 in which the first band is supported along its approximately horizontal path by a support member lying above the band and having a lower surface which is concave in cross-section so that the band becomes concave in cross-section and imparts a convex shape to the upper surface of the filler stream.

9. A machine according to claim 8 in which the support member has suction ports.

10. A machine according to any one of claim 1, in which the first band has relatively large apertures or is woven with a relatively coarse weave, and the second band has relatively small apertures or is woven with a relatively fine weave.

11. A cigarette making machine comprising a first air-pervious band; means for delivering a tobacco shower onto the first band along an operative run of the said band to form a cigarette filler stream on the band; suction means for transmitting suction through the band for holding and compressing the filler stream on the band; means for conveying adjacent to the first band a continuous wrapper web to receive the filler stream, and for securing the wrapper web around the filler stream to form a cigarette rod; and a second air-pervious band mounted within the first band and having an operative run which contacts and supports the operative run of the first band at least in the region of the tobacco shower; the second band having bearing edge portions by which it is supported and which lie laterally beyond the edges of the first band; and said second band having a return pulley, at the end of the operative run thereof, whereby the second band parts from the first band at a position upstream of the position at which the filler stream arrives on the wrapper web.

* * * * *